United States Patent [19]

Bedics

[11] Patent Number: 4,804,570

[45] Date of Patent: Feb. 14, 1989

[54] ROLL-UP MATTING AND METHOD OF ASSEMBLY

[75] Inventor: Michael A. Bedics, Poughquag, N.Y.

[73] Assignee: Pawling Corporation, Pawling, N.Y.

[21] Appl. No.: 57,628

[22] Filed: Jun. 3, 1987

[51] Int. Cl.[4] ..... E04C 1/30; B32B 3/06

[52] U.S. Cl. ..... 428/53; 428/54; 428/62; 428/100; 52/181; 15/217

[58] Field of Search ..... 428/53, 81, 61, 62, 428/52, 100, 54; 52/181, 177; 15/215–217

[56] References Cited

U.S. PATENT DOCUMENTS

| | | |
|---|---|---|
| Re. 32,061 | 1/1986 | Ellingson, Jr. . |
| 4,029,834 | 6/1977 | Bartlett . |
| 4,568,587 | 2/1986 | Balzer . |
| 4,654,245 | 3/1987 | Balzer et al. . |
| 4,663,903 | 5/1987 | Ellingson, Jr. . |
| 4,675,222 | 6/1987 | Berndt, Jr. . |

*Primary Examiner*—Alexander S. Thomas
*Attorney, Agent, or Firm*—Schweitzer & Cornman

[57] ABSTRACT

An articulated floor mat structure is disclosed, in which a series of rigid, slat-like elements are hinged together and locked to prevent lateral movement, to form a mat structure that can be rolled up. The individual structural elements are shaped to provide for slide-in or snap-in assembly of tread strips, along their upper surfaces, and pad strips, along their lower surfaces. Edge strips are secured along the side edges of the mat assembly in an advantageous manner, to retain the tread strips and pad strips in assembled positions. An arrangement of integral loop tabs on the edge strips and integral hook tabs on the structural members greatly expedites the assembly process and correspondingly reduces the cost of manufacture, without compromising performance.

7 Claims, 2 Drawing Sheets

ROLL-UP MATTING AND METHOD OF ASSEMBLY

BACKGROUND AND SUMMARY OF THE INVENTION

The invention is directed to the design and construction of entrance mats, for lobby and marquee areas, for example, and particularly to matting of articulated construction, formed of relatively rigid, slat-like units, connected by hinges and arranged to be rolled up for removal and storage. Roll-up matting is, in general, known to the art in such forms as reflected in the Bartlett U.S. Pat. No. 4,029,834, the Balzer U.S. Pat. No. 4,568,587, the Ellingson U.S. Pat. No. Re. 32,061, and the like. Such matting has been sold by Pawling Corporation under the trademarks "Rol Del-I" and "Rol Dek-II" and is illustrated in Pawling Corporation's "Selection Guide 1987, Floor Mats & Matting". In each of these known constructions, a floor mat structure is comprised of elongated, relatively narrow slat-like elements, formed of relatively rigid material, such as extruded metal or extruded structural plastic. Extruded aluminum is a material of choice for this purpose. The individual slats may be a few inches in width and several feet in length, and are connected in an articulated manner, so that each is hingedly associated with its neighbor.

In the construction of the Bartlett U.S. Pat. No. 4,029,834, ball and socket type hinge element are integrally formed in the extruded slat-like members. The ball and socket hinge elements are continuously extruded on opposite edges of the members and enables one slat-like member to be hingedly joined to its neighbor.

In the structure of the Balzer and Ellingson U.S. Pat. Nos. 4,568,587 and Re. 32,061, adjacent slat-like members are joined by separate, elongated hinging elements. In the case of the structure of the Balzer patent, the hinge elements are formed of a flexible material, so that adjacent rigid slat-like members are hingedly joined with each other through the medium of a bendable, resilient connnector. In the case of the Ellingson U.S. Pat. No. Re. 32,061, the principal slat-like members are joined by a rigid ball and socket type hinge member which joins neighoring slats. The slats thus may be formed with female hinge grooves, which are joined in the assembly with an elongated, narrow hinge element, formed of a pair of continuous ball-type hinge elements along its opposite edges.

In all of the foregoing constructions, matting of relatively rigid construction, and typically formed of extruded aluminum slat-like sections, can be easily rolled up for removal and storage.

The present invention is directed to roll-up matting of the general type represented by the above described structures, which is characterized by the corporation of a plurality of structural improvement features which simplify and expedite the construction and assembly of the mat and thereby significantly reduce its final cost.

In roll-up mats of known construction, the individual slat-like members are commonly constructed of a principal structural element of extruded aluminum. The aluminum slats are formed with an upwardly opening channel on their upper faces, provided at opposite sides with short, inwardly directed flanges. Elongated tread strips, wihch may be formed of carpet-like material, plastic, or the like, are slideably received endwise into the open slat channels or inserted by engaging one side of the slat channel and then folding and snap-fitting the tread thus engaging the other side and provide a resilient mat surface in the assembled structure. The lower surface of the extruded aluminum slat section typically is provided with a spaced apart pair of channels extending the full length of the slat (i.e. from side to side of the assembled mat). These channels are likewise formed with opposed, inwardly extending flanges, for receiving resilient pad strips, which extend from one end to the other of the slat-like members.

In most of the structures of heretofore known design, elements of generally similar purpose to those described above have been utilized. In order to retain the strip-like elements in their assembled positions within the extruded slat-like sections, mat structures of known types historically have utilized somewhat cumbersome and/or labor intensive arrangements. In some cases, the tread strips may be riveted in place at one or both ends of the metal slat, for example. If the element is designed to be sufficiently frictionally tight on assembly, problems may be encountered during the assembly operation in feeding a highly elongated, thin, narrow strip into the full length of its supporting metal strip. Accordingly, it is preferable to allow reasonable clearance to secure the tread strip after its assembly. In the case of the pad strips, extending along the bottom of the extruded slat-like sections, one common practice has involved the use of elongatable, resilient elements, such as shown in the Bartlett U.S. Pat. No. 4,029,834, for example. These elements can be stretched lengthwise, by workers stationed at opposite ends of the mat during assembly. The elongated elastic elements are thus reduced in diameter sufficiently to be forced into restricted slat openings of grooves provided for their reception. After insertion of the grooves, the longitudinal tension can be removed, allowing the elements to contract in length and expand in diameter sufficiently to be retained in position. This operation, of course, requires the cooperation of two workers and is highly labor intensive.

In accordance with the present invention, a roll-up mat structure is provided, which is so designed as to enable the upper tread elements and the lower pad strips to be freely inserted endwise or topwise, from one side of the mat. A resilient nosing strip, extending along each side edge of the mat, and which is easily and quickly attached to the assembled slat-like elements, serves to retain all of the tread strips and pad strips in their assembled positions. The resilient nosing strips, pursuant to the structure of the invention, are quickly and easily attached along the side edges of the mat structure without riveting or other time consuming manufacturing steps. The various elements of the mat are effectively maintained in assembled relation, yet substantial manufacturing cost is avoided.

For a better understanding of the above and other features and advantages of the invention, reference should be made to the following detailed description of a preferred embodiment and to the accompanying drawings.

DESCRIPTION OF A PREFERRED EMBODIMENT

Figure 1:
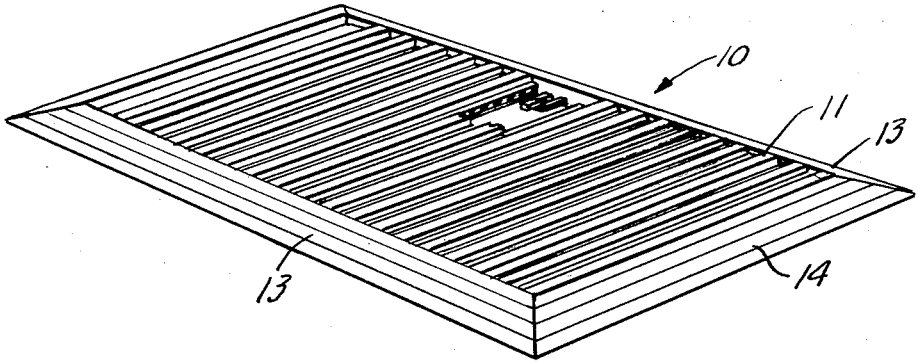
FIG. 1 is a simplified, perspective view of a fully assembled mat constructed in accordance with the teachings of the present invention, with a small area broken away for illustration.
Figure 8:
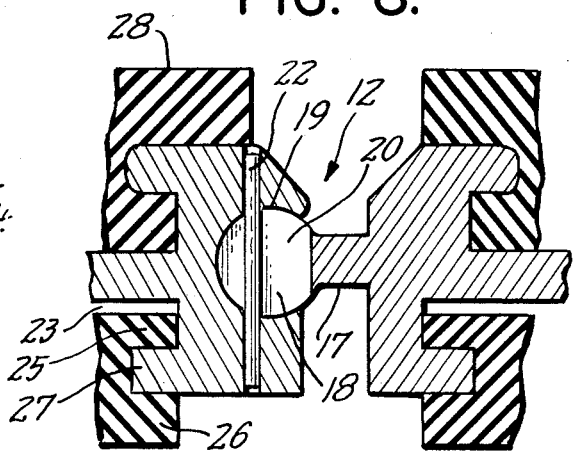
FIG. 8 is an enlarged, fragmentary cross sectional view showing details of hinge structure and locking means.
Figure 2:
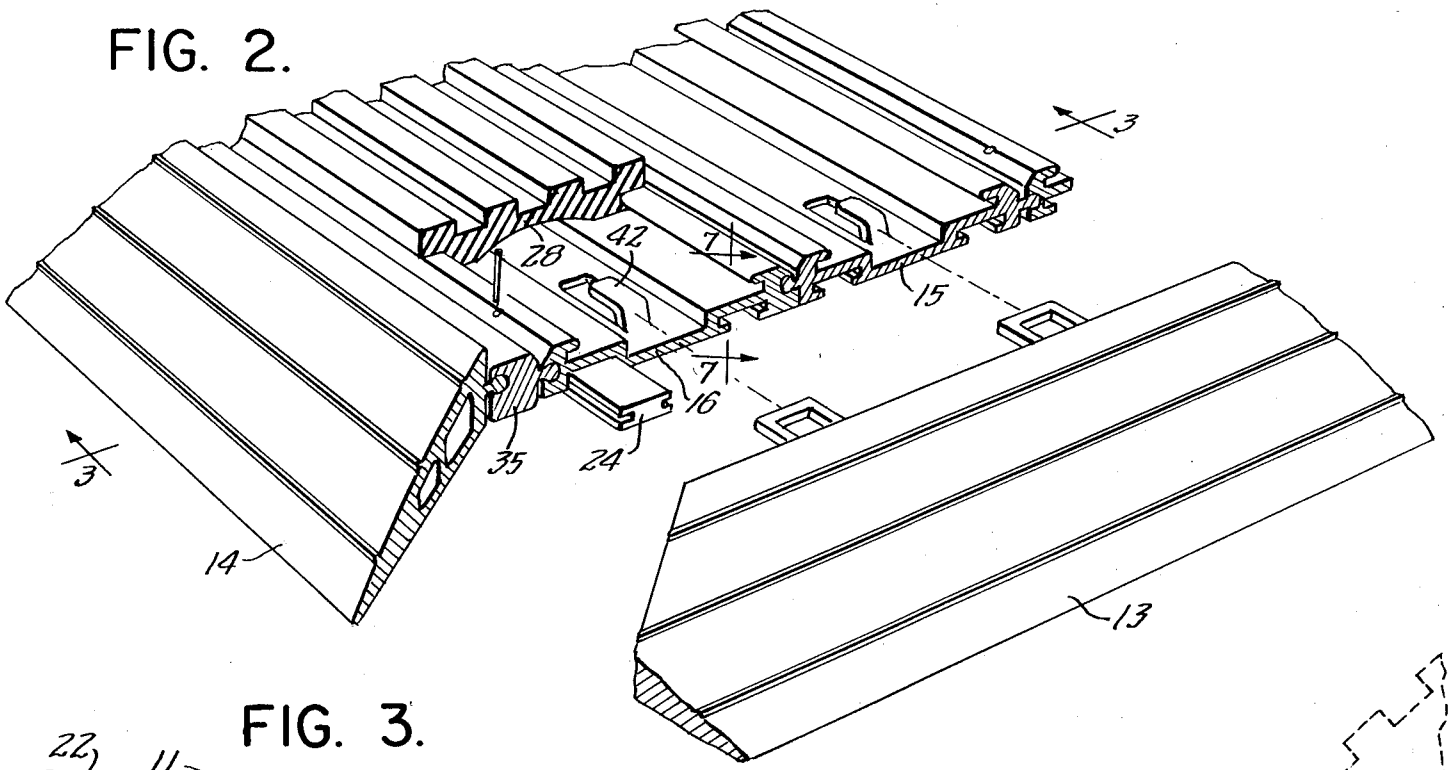
FIG. 2 is a highly enlarged, fragmentary perspective view of a corner area of the mat of FIG. 1, showing certain of the parts in a partially exploded view to illustrate the manner of assembly.

Referring now to the drawings, and initially to FIG. 1 thereof, the reference numeral 10 designates in a general way an articulated mat structure formed of a plurality of laterally extending, relatively rigid, slat-like sections 11, secured to adjacent sections along their full length by hinge joints 12 (see FIG. 8). A mat structure is provided which is relatively rigid in the width direction, but which may be rolled up in the lengthwise direction for removal and storage. In some installations, the articulated slat sections 11 are installed in a recess (not shown) provided in the flooring area. In other cases, the mat structure is simply laid over the top of an existing floor surface. In the latter case, nosing strips 13, 14 are provided around the four edges of the mat. The nosing strips are of tapered cross sectional profile to provide a transition from the floor level to the somewhat more elevated level of the mat surface.

Figure 3:
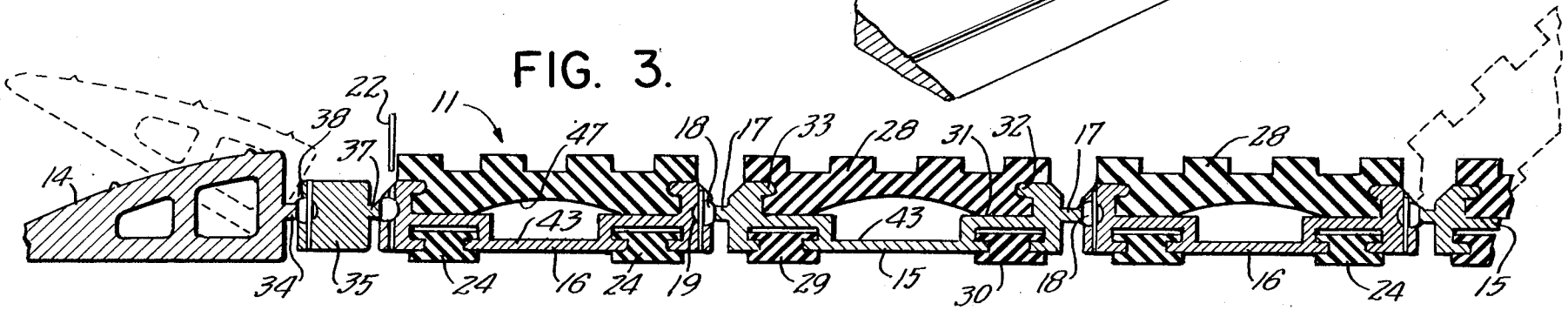
FIG. 3 is an enlarged, transverse, cross sectional view as generally on line 3—3 of FIG. 2.

With reference now to FIG. 3, the articulated, slat-like strips 11 are comprised of alternating pairs of "male" and "female" metal strip sections 15, 16. Most desirably, the strip sections 15, 16 are formed of extruded aluminum, but in some cases extruded plastic materials are also satisfactory. Along each side edge of the "male" strip sections 15 is a continuous hinge element comprising a relatively narrow neck 17, extending horizontally from the side of the strip section, and an enlarged, cylindrical hinge element 18. In the adjacent "female" slat sections 16, there are provided continuous cylindrical recesses 19, partially open at the side edges of the strips 16. The recesses 19 are open at a width less than the maximum diameter of the cylindrical hinge sections 18 but greater than the thickness of the neck 17. Accordingly, when an adjacent pair of slat sections 15, 16 is assembled by endwise insertion of the hinge sections 18 into the recesses 19, the adjacent sections are secured together for limited articulated motion. The limit of the hinging action is determined by the thickness of the neck portion and the width of the opening 18 at the side of the recess 19, as will be understood.

Figure 7:
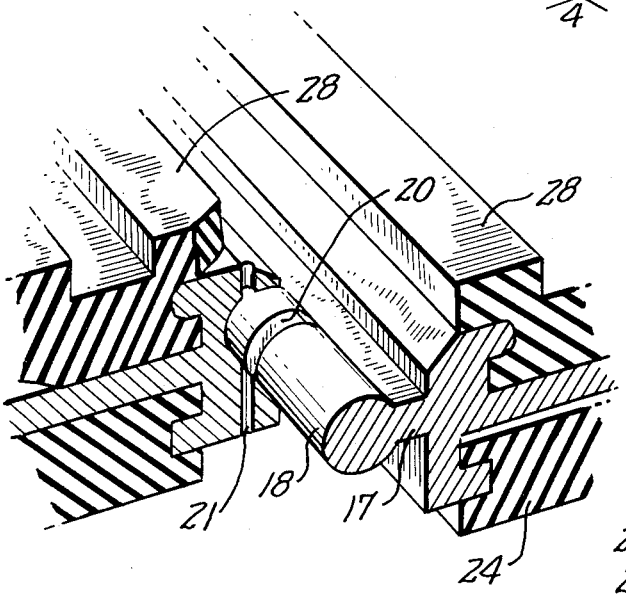
FIG. 7 is a highly enlarged, fragmentary perspective view of a mat structure as taken generally on line 7—7 of FIG. 2.

In the illustrated construction, the cylindrical hinge sections 18 are provided at one or more locations, preferably adjacent the ends of convenience, with transverse slots 20 (see FIG. 7, 8). These transverse slots are aligned, in the assembled mat structure, with vertical bores 21, extending through the female strips 16 and intersecting the cylindrical hinge recesses 19. When a connected pair of strips 15, 16 is properly assembled and aligned, a pin 22, preferably a hollow, tapered roll pin, is driven into the bore 21. This locks the articulated members against relative lateral motion, while permitting the desired degree of hinge motion.

Along the bottom of each of the metal strips 15, 16 there are provided spaced, downwardly opening recesses 23, extending continuously over the full length of the strips, from one side to the other of the mat structure. In the illustrated arrangement, the recesses 23 are of generally T-shaped cross section, although the particular cross section is not critical. Received in the spaced recesses 23 are spaced pad strips 24, which desirably are of a squat "I-shaped" cross section, having short flange portions 25, 26 extending respectively above and below inwardly projecting flange elements 27 formed integrally with the metal strips 15, 16. The resilient pad strips 24 are assembled with the metal strip sections 15, 16 by inserting the pad strips lengthwise into their respective recesses. The dimensions and tolerances of the parts is such that a relatively easy sliding assembly can be accomplished.

Each of the metal strips is also provided with a continuous tread strip 28. The tread strips 28 typically may be formed of a relatively strong, resilient plastic material provided adjacent its bottom surface with outwardly extending flange portions 29, 30. The flange portions are received within inwardly facing channels formed by upwardly facing support surfaces 31 of the metal strips and inwardly directed flanges 32, 33 which overlie edge portions of the support surfaces 31. The tread strips 28 advantageously are of extruded plastic construction, designed to have a sliding fit with the respective metal strip sections 15, 16, in order to accommodate assembly by endwise insertion of the tread strips into the metal strips. Carpet strips and the like may also be utilized, in accordance with known technology.

Figure 9:
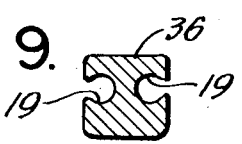
FIG. 9 is a cross sectional view of a form of adapter strip utilized at one end of the mat structure for joining two "male" hinge elements.

At the opposite ends of the mat structure, there are provided end nosing members 14. These, for the sake of manufacturing convenience, are provided with "male" hinge elements 34, for running continuously the full width of the mat. Depending on the particular length and construction of the mat, the endmost articulated slat-like strips 15, 16 could be either both "male", "female" or one of each. Accordingly, transition elements 35 (FIG. 3) and 36 (FIG. 9) are provided to accommodate any of these situations. As shown in FIG. 3, a male/female transition element 35 is installed. It is provied on one side with a male hinge element 37 and on the opposite side with a recess 38 for reception of the nosing hinge element 34. The transition element 36, shown in FIG. 9, is female/female, and is provided with hinge recesses 19 on opposite sides. The transition element 36 is utilized where the endmost strip is a "male" strip 15.

Figure 4:
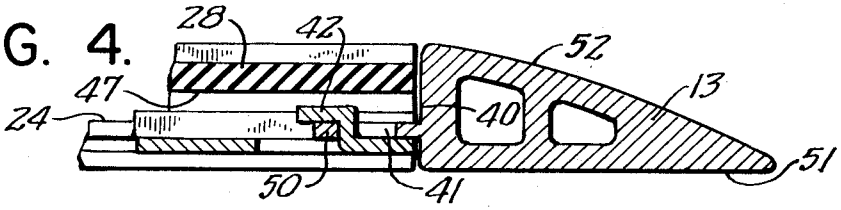
FIG. 4 is an enlarged, fragmentary, cross sectional view as taken generally on line 4—4 of FIG. 6.

In accordance with the invention, a simplified and highly advantageous arrangement is provided for securing the various pad strips 24 and tread strips 28 in assembled relation with the respective metal strips 15, 16. Instead of individually riveting or otherwise securing elements to the metal strips, which can involve numerous time consuming and expensive operations, or relying upon high friction or distortion fits, which makes the assembly somewhat difficult and more labor intensive, the present invention allows for relatively free sliding, endwise insertion or replacement of the pad and tread strips, and secures these elements in assembled position by means of the edge nosing strips 13. Thus, as reflected particularly in FIGS. 4–6, the edge nosing strips 13 are provided with generally vertical inner walls 40, which extend from the floor surface approximately to the tops of the tread strips 28. When these nosing strips are positioned adjacent the side edges of the assembled, articulated mat structure, the slideable strips 24, 28 are blocked against lateral displacement from their assembled positions.

Figure 5:
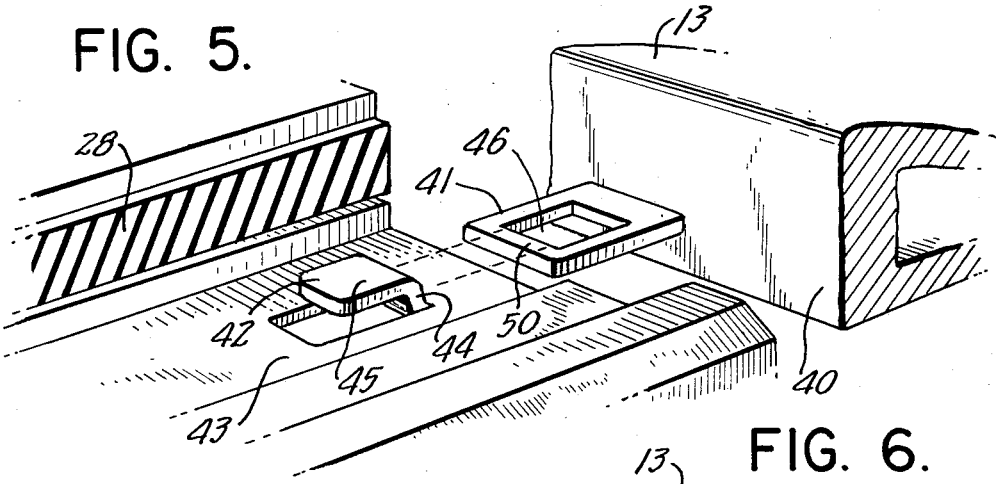
FIGS. 5 and 6 are enlarged, fragmentary perspective views illustrating a sequence of steps involved in assembly of a resilient nosing strip to the side edge of a mat structure.
Figure 6:
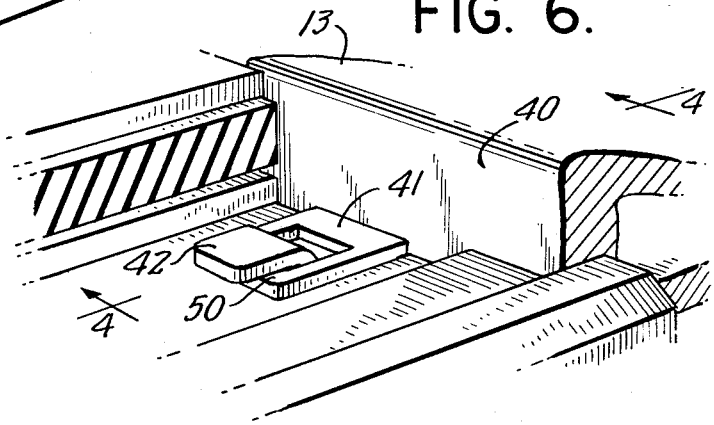

Pursuant to the invention, the side nosing strips 13 are provided along their inner edges with flexible, elastic loop tabs 41 for attachment of the nosing strips to the articulated mat. The loop tabs are provided at spaced intervals along the length of the nosing strips 13, ideally one such loop tab 41 opposite each articulated slat-like strip of the mat. The loop tabs 41 may be formed by extruding along the inner edge of the strip a continuous, laterally projecting flange, and then die cutting or otherwise removing spaced, intervening portions of the flange leaving relatively narrow laterally projecting loop tabs 41, as shown in FIG. 5, for example.

To particular advantage, the attachment of the loop tabs to the articulated mat strips is accomplished by means of punched-out offset hook tabs 42 formed in the central flat lower surface portions 43 of the metal strips 15, 16. By means of a simple punching and forming operation, an L-shaped hook tab 42 may be displaced upwardly from the bottom surface 43, providing a short upwardly extending tab section 44 integrally attached to the strip 15 or 16, and a horizontally extending portion 45 projecting inwardly, parallel to the bottom surface 43 but spaced thereabove a distance corresponding generally to the thickness of the loop tabs 41. The loop tabs 41, attached to the nosing strips, are provided with internal openings 46 of a size and shape to be received over the free ends of the offset hook tabs 42. The geometry of the hook tabs 42 and the loop tabs 41 is such that, when the elements are engaged, the nosing strips 13 are held closely against the side edges of the articulated mat strips, as reflected particularly in FIGS. 4 and 6. Advantageously, cooperating pairs of hook and loop tabs are provided at the ends of each of the articulated sections.

As reflected in FIG. 3, the bottom surfaces 43 of the metal strip sections 15, 16 are offset below the arched lower surfaces 47 of the tread strips. This provides sufficient open space to accommodate the presence of the respective hook and loop tabs 42, 41.

Assembly of the resilient pad strips 24 and the tread strips 28 is extremely simplified and expeditious in the structure of the invention. Initially, the pad strips 24 are inserted endwise in their respective channels 23. This may be done before or after the plurality of slat-like metal strip sections 15, 16 have been joined and pinned. Preferably, the pad strips are inserted after assembly of the hinged metal sections to each other.

After all of the hingedly connected sections of the assembly have been joined, including the transition elements 35, 36 and end nosings 14, and after the pad strips 24 have been inserted lengthwise in their retaining channels, the edge nosing strips 13 are assembled and secured. This is quickly and easily accomplished by tilting the edge nosing upward, substantially to a vertical orientation, enabling the respective loop tabs 41 to project downward to be applied over the inwardly projecting ends of the hook tabs 42.

The length of the integral loop tabs 41 is such as to enable the outermost transverse element 50 thereof to be engaged underneath the upwardly displaced hook tabs 42, when the nosing strip 13 is generally vertically oriented with the loop tabs projecting downward. The nosing may thereafter be displaced laterally outward and then rotated downward the horizontal position, as reflected in FIG. 6. When the nosing is in a horizontal position, the front elements 50 of the loop tabs is locked under the hook tabs 42, retaining the nosing 13 in position adjacent and generally abutting the end edges of the articulated strips.

Pursuant to the invention, the elasticity in the retaining elements 41, together with the provision of some clearance space between the transverse section 50 and the upwardly extending hook tab section 44, enables the nosing strip 13 to be pivoted downwardly, relative to the articulated strips, sufficiently to allow access for the slide-in assembly of the tread strips 28. After installation of the tread strips 28, the downward pivoting force on the nosing strip 13 is released, allowing the nosing strip to return to a more normal position, in which the just-installed tread strips 28 are effectively locked in place. When the mat is in use, of course, the side nosing strips 13 are supported by the floor surface and are thus prevented under any circumstances from being pivoted in a downward direction. As reflected particularly in FIG. 4, the location of the loop tabs 41 is substantially closer to the bottom surface 51 of the nosing strip 13 than to the upper surface 52. Accordingly, while the nosing may readily be pivotally diplace in a downward direction, for assembly of the tread strips 28, pivoting in the upward direction is effectively prevented after assembly of the tread strips 28.

Inasmuch as the side nosing strips 13 are formed of a resilient material, they flex sufficiently to accommodate rolling up of the articulated slat-like elements for removal and storage of the assembled mat. In the rolled-up condition of the mat, the side nosing strips 13 are effectively locked against any pivoting action, assuring that the pad strips 24 and tread strips 28 remain effectively retained in their assembled positions.

The features of the invention enable articulated mat structures, in themselves generally of known design and construction, to be assembled more expeditiuosly and more economically by using edge strips on opposite sides to retain a plurality of pad strips and tread strips in their assembled positions with respect to individual articulated slat sections. Once the individual elements have been assembled, all of the strip-like pads and treads are automatically retained in assembled position without individual securement, by the presence of the edge strips, which prevent lateral displacement of the pad and tread strips.

To particular advantage, the side edge strips are securable to the articulated slat sections, by a series of loop-like securing elements extending integrally from the edge strips and joined with offset hook tabs formed integrally in the articulated slat sections. The initial assembly of the edge strips requires a generally upright rotational orientation thereof, in order to effect initial engagement of the tabs. Subsequently, after the tread strips have been installed in position, it is no long possible to pivot the edge strips back into a generally vertical orientation. As a result, while the edge strip serves to retain the tread strips in assembled relation, the tread strips in turn serve to lock the edge strips in assembled relation. All of this is accomplished without the use of time consuming (and therefore costly) procedures of the prior art. These have included the use of rivets, the staking of assembled parts, the installation of pad strips by elastic distortion, etc. With the mat design of the present invention, all of the strip-like elements may be designed for relatively easy slide-in assembly, and the necessary retention is provided by the presence of the edge strips 13.

It should be understood, of course, that the specific form of the invention herein illustrated and described is intended to be representative only, as certain changes may be made therein without departing from the clear teachings of the disclosure. By way of example, the illustrating edge strip is in the form of a tapered nosing, utilized to provide for elevational transition when the mat is placed on a flat floor. For articulated mat assemblies designed for installation in a recessed frame, flush with the floor level, the tapered nosing strips are replaced by narrower, untapered edge strips forming a thin, resilient border between the articulated structural elements and the surrounding recessed frame. The side edge strips, for such installations, will function in the same way as the nosing strips 13 specifically illustrated, as regards the assembly and retention procedures. Accordingly, reference should be made to the following appended claims in determining the full scope of the invention.

I claim:

1. In an articulated mat assembly having a plurality of elongated rigid structural elements extending from side to side of the assembly and hingedly connected to each other along their edges, (a) a tread strip slideably insertable endwise into each structural element to provide a tread surface along the top of said mat assembly, (b) one or more pad strips slideably insertable endwise into each structural element to form a pad surface along the bottom of said mat assembly, and (c) means to retain said slideably insertable strips in assembled position comprising elongated, resilient edge strips secured to the opposite end edges of said structural elements, defining the opposite side edges of said mat structure, (d) resilient connecting tab means, integral with said edge strips, joining said edge strips to said structural elements and accommodating downward displacement of said edge strips, when unsupported by a floor or the like, to permit slideable insertion and removal of said tread strips into and out of said structural elements.

2. An articulated mat according to claim 1, further characterized by (a) said structural elements being formed with integral, inwardly projecting hook tabs engageable by said loop tabs in certain limited, upwardly displaced orientation of said edge strips, (b) said tread strips, when in assembled position, preventing said edge strips from being moved into said limited, upwardly displaced orientations.

3. In an articulated floor mat assembly comprising a plurality of hingedly connected, generally rigid slat elements, and strip elements slideably assembled with said slat elements, the improvement characterized by (a) said strip elements comprising tread strips, (b) said slat elements being of extruded construction and having confining recesses for the slideable reception of said tread strips, (c) retainer abutment means at the opposite side edges of said mat assembly for retaining said strip elements in assembled relation to said slat elements, (d) said retainer means on at least one side of said assembly comprising a continuous elongated edge member of elastomeric material preventing endwise movement of said strip elements, (e) integral resilient connecting means joining said edge member to said articulated slat elements, (f) said resilient connecting means comprising integral loop tabs extending laterally from said edge member, (g) said slat elements being formed with integral loop-engageable hook tabs for engaging said loop tabs and thereby securing said edge member to said slat elements, (h) said edge member being resiliently pivotally displaceable downward during assembly to provide slide-in access to the ends of said confining recess for assembly of said tread strips, (i) said edge member having an inner wall normally positioned in generally abutting relation to the adjacent side edge of said mat assembly effectively blocking access to and egress from the ends of said confining recesses.

(j) said strip elements being free of securement to said slat elements and retained by said retainer abutment means.

4. The improvement of claim 3, further characterized by (a) said hook tabs being formed by upward displacement of tab portions of said slat elements from the bottoms of said confining recesses, (b) said slat elements and tread strips being so formed as to provide, in the assembled structure, vertical spaces for the accommodation of said hook and loop tabs.

5. The improvement of claim 3, further characterized by (a) said slat elements being provided with downwardly opening channel recess means, (b) pad strip elements slideably insertable in said downwardly opening recess means, (c) said pad strip elements being retained in said slat elements by the abutting wall of said edge member.

6. The improvement of claim 3, further characterized by (a) said edge member being attachable to said slat elements when oriented in an upwardly pivoted position, with said loop tabs projecting downward to engage said hook tabs, (b) said tread strips, after assembly thereof with said slat elements, serving to prevent upward pivoting movement of said edge member to a position enabling detachment of said loop tabs from said hook tabs.

7. The improvement of claim 3, further characterized by (a) said assembly having an edge member along each side.

* * * * *